US010822809B1

(12) United States Patent
Linnane et al.

(10) Patent No.: US 10,822,809 B1
(45) Date of Patent: Nov. 3, 2020

(54) MODULAR DECKING ASSEMBLY

(71) Applicants: Joseph Linnane, Charlotte Hall, MD (US); Debra Linnane, Charlotte Hall, MD (US)

(72) Inventors: Joseph Linnane, Charlotte Hall, MD (US); Debra Linnane, Charlotte Hall, MD (US)

( * ) Notice: Subject to any disclaimer, the term of this patent is extended or adjusted under 35 U.S.C. 154(b) by 0 days.

(21) Appl. No.: 16/506,452

(22) Filed: Jul. 9, 2019

(51) Int. Cl.
*E04F 15/02* (2006.01)
*E04B 1/00* (2006.01)

(52) U.S. Cl.
CPC ..... *E04F 15/02038* (2013.01); *E04B 1/003* (2013.01); *E04F 2201/0505* (2013.01)

(58) Field of Classification Search
CPC ..... E04B 1/003; E04F 2201/0505
See application file for complete search history.

(56) References Cited

U.S. PATENT DOCUMENTS 3,310,919 A * 3/1967 Bue ..... E01C 9/08 52/127.11
5,050,362 A * 9/1991 Tal ..... E04C 2/543 404/41
5,758,467 A * 6/1998 Snear ..... E04C 2/20 52/177
6,021,646 A * 2/2000 Burley ..... A63C 19/10 165/45
6,684,592 B2 2/2004 Martin
7,047,697 B1 * 5/2006 Heath ..... E04F 15/10 52/177
8,011,148 B2 9/2011 Bertke
8,205,407 B2 6/2012 Genova
9,611,658 B2 4/2017 Evans
9,809,970 B2 11/2017 Burns
2006/0265987 A1 11/2006 Iannone
2016/0312490 A1 * 10/2016 McDowell ..... E01C 5/00
2017/0107725 A1 * 4/2017 Jones ..... E01C 9/086
2018/0030667 A1 * 2/2018 Penland, Jr. ..... E01C 5/18
2018/0094442 A1 * 4/2018 Barlow ..... E04F 15/18
2019/0119863 A1 * 4/2019 Penland, Jr. ..... E01C 5/18
2019/0284818 A1 * 9/2019 Penland, Jr. ..... E01C 5/005

* cited by examiner

*Primary Examiner* — Babajide A Demuren

(57) ABSTRACT

A modular decking assembly for defining a floor to stand upon includes a plurality of panels that each has a tongue and a groove. The tongue on each of the panels releasably engages the groove on an adjacent one of the panels. In this way the panels can be coupled together to define a support surface for standing or sitting. Each of the panels is positionable on the ground and each of the panels is comprised of a fluid impermeable material to inhibit people's feet from getting wet during standing. A plurality of pins is provided and each of the pins is extendable through a respective panel and engages an adjacent panel for removably coupling the panels together.

5 Claims, 9 Drawing Sheets

MODULAR DECKING ASSEMBLY

CROSS-REFERENCE TO RELATED APPLICATIONS

Statement Regarding Federally Sponsored Research or Development

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to decking devices and more particularly pertains to a new decking device for defining a floor to stand upon.

BRIEF SUMMARY OF THE INVENTION

An embodiment of the disclosure meets the needs presented above by generally comprising a plurality of panels that each has a tongue and a groove. The tongue on each of the panels releasably engages the groove on an adjacent one of the panels. In this way the panels can be coupled together to define a support surface for standing or sitting. Each of the panels is positionable on the ground and each of the panels is comprised of a fluid impermeable material to inhibit people's feet from getting wet during standing. A plurality of pins is provided and each of the pins is extendable through a respective panel and engages an adjacent panel for removably coupling the panels together.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
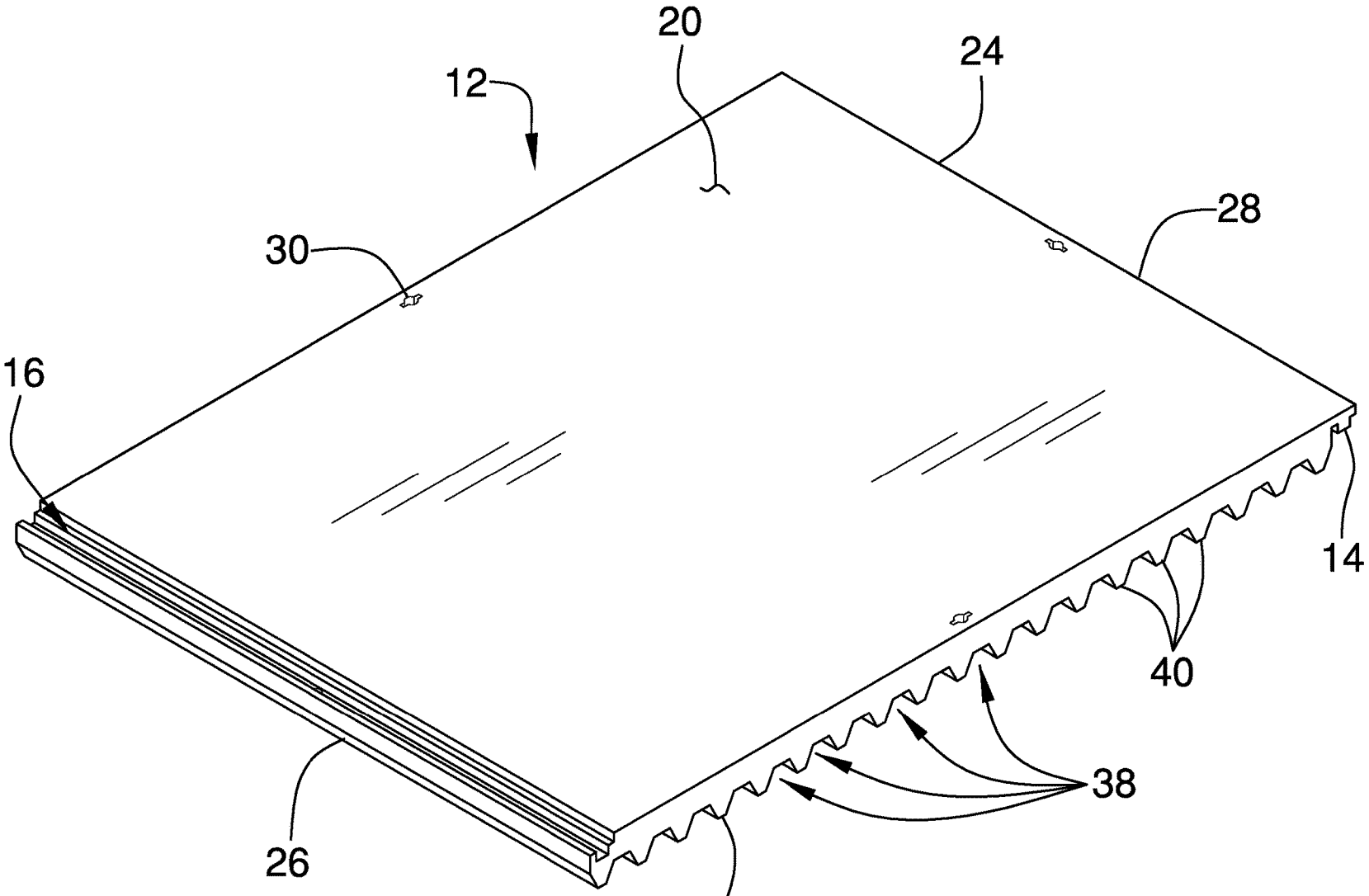
FIG. 1 is a top perspective view of a modular decking assembly according to an embodiment of the disclosure.
Figure 2:
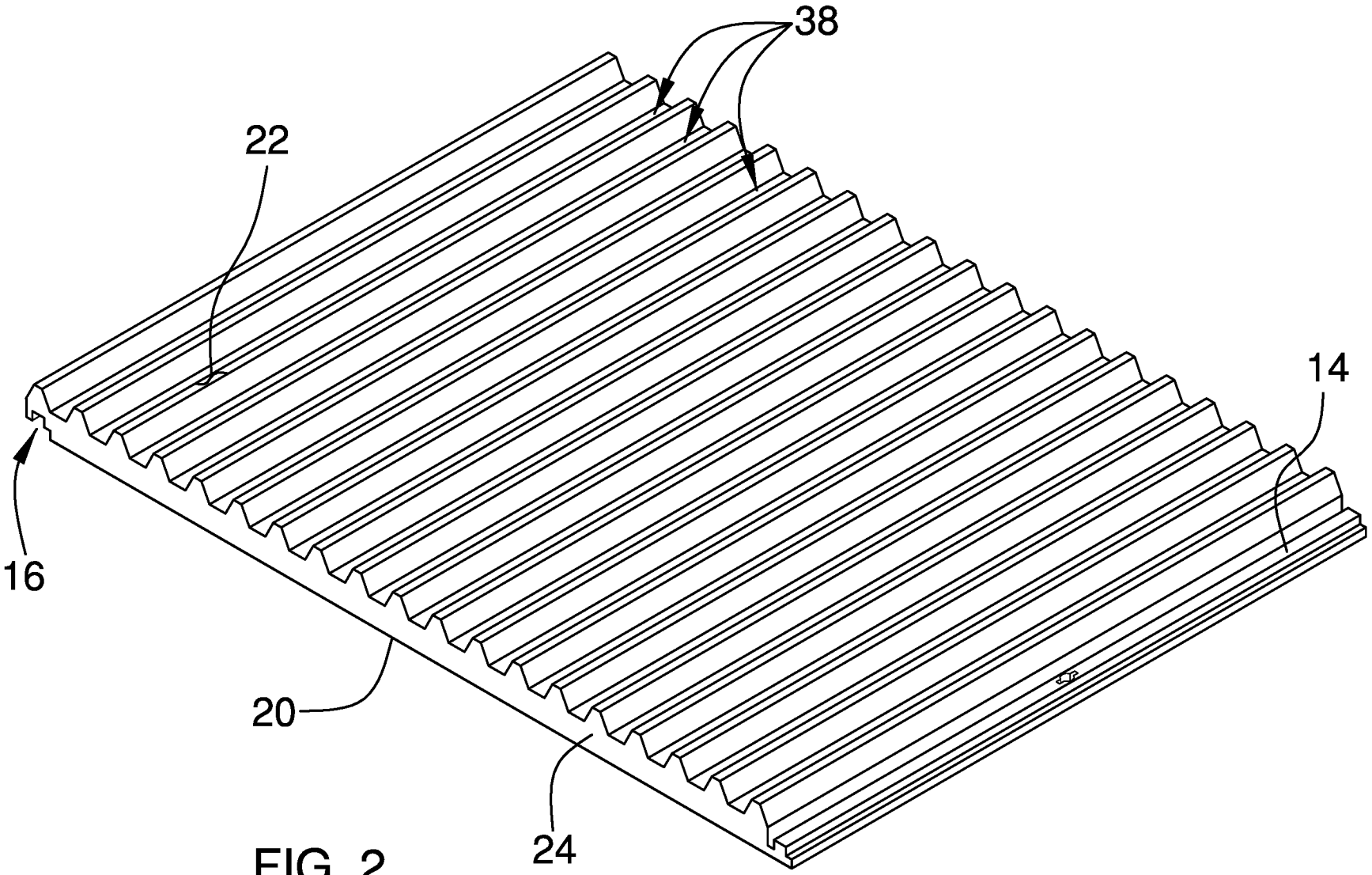
FIG. 2 is a bottom perspective view of an embodiment of the disclosure.
Figure 3:
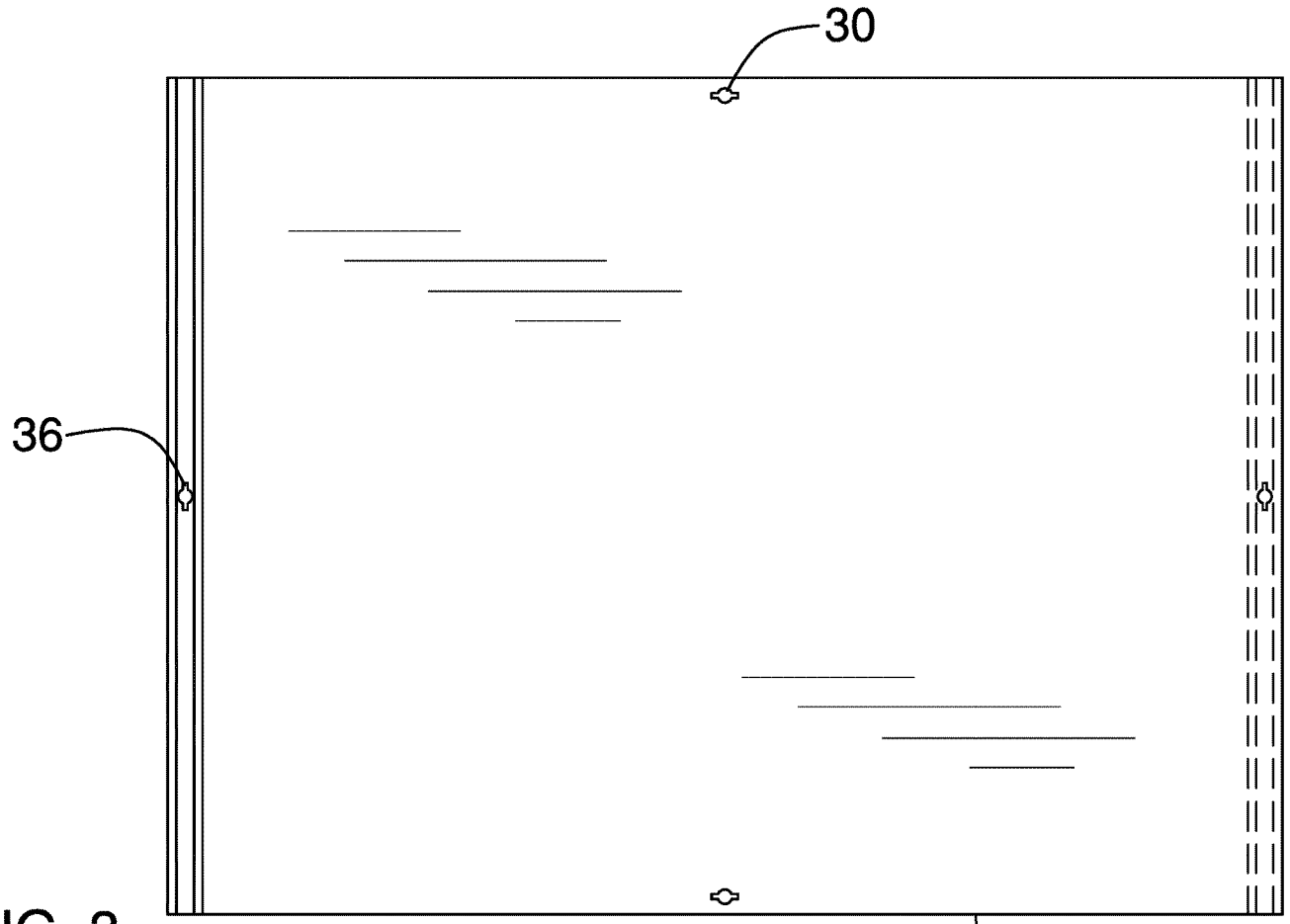
FIG. 3 is a top phantom view of an embodiment of the disclosure.
Figure 4:
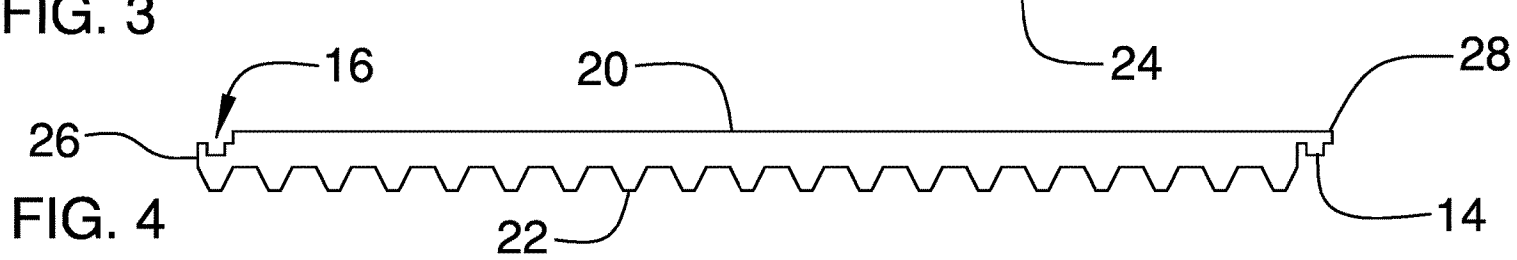
FIG. 4 is a right side view of an embodiment of the disclosure.
Figure 5:
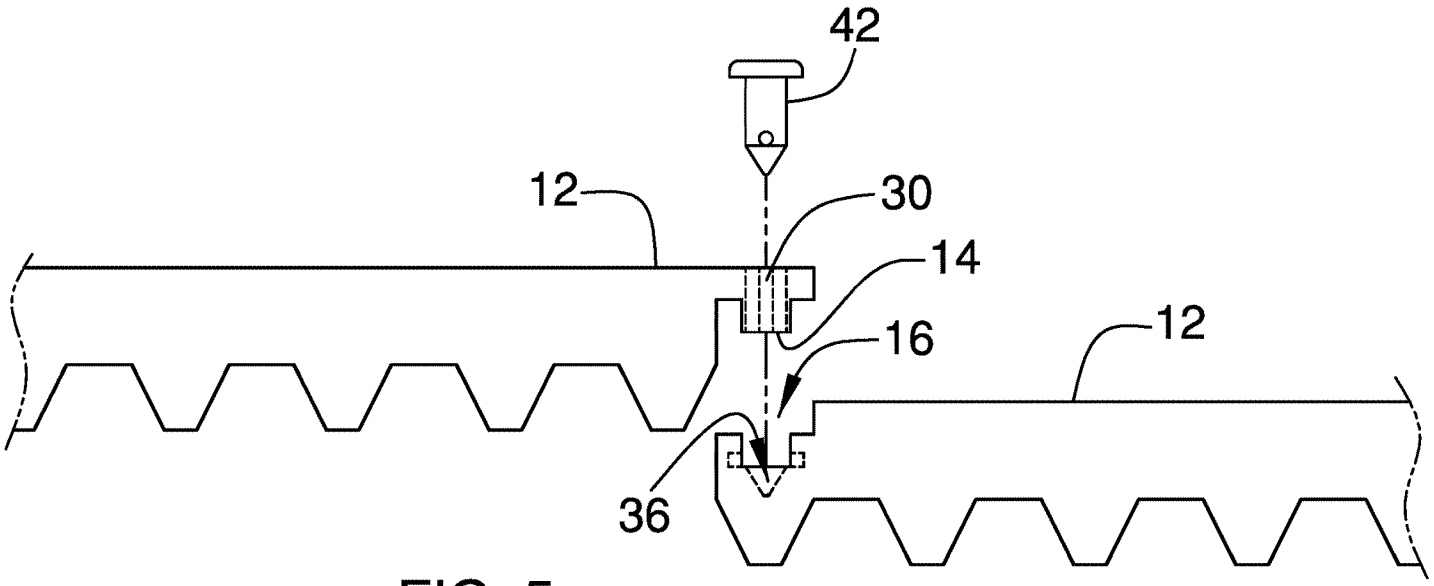
FIG. 5 is an exploded perspective view of an embodiment of the disclosure.
Figure 6:
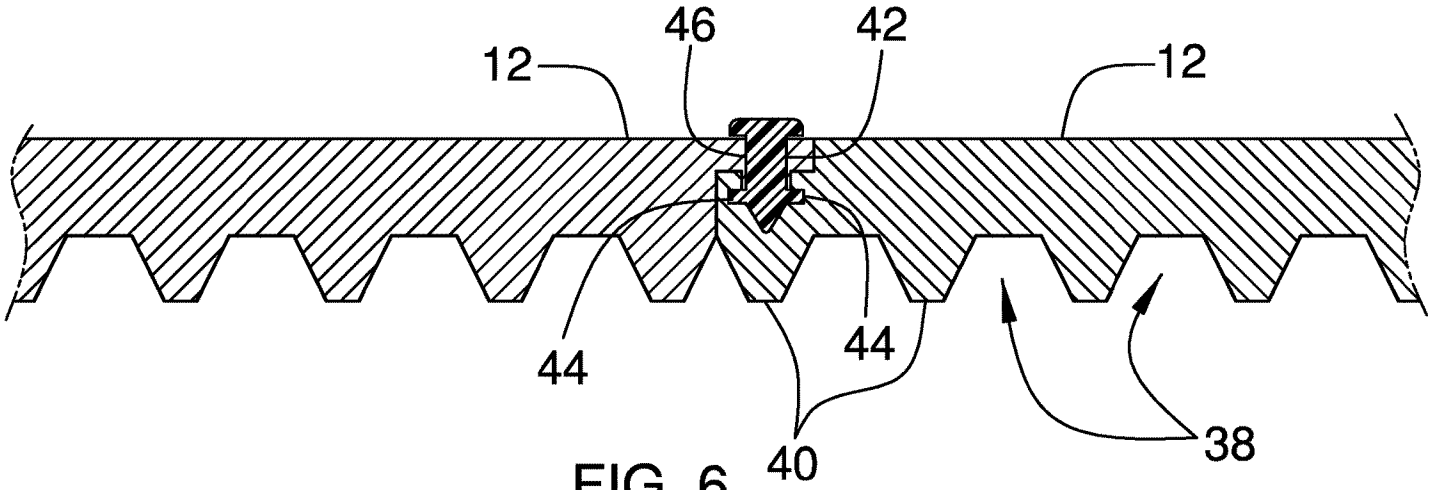
FIG. 6 is a cut-away in-use view of an embodiment of the disclosure.
Figure 7:
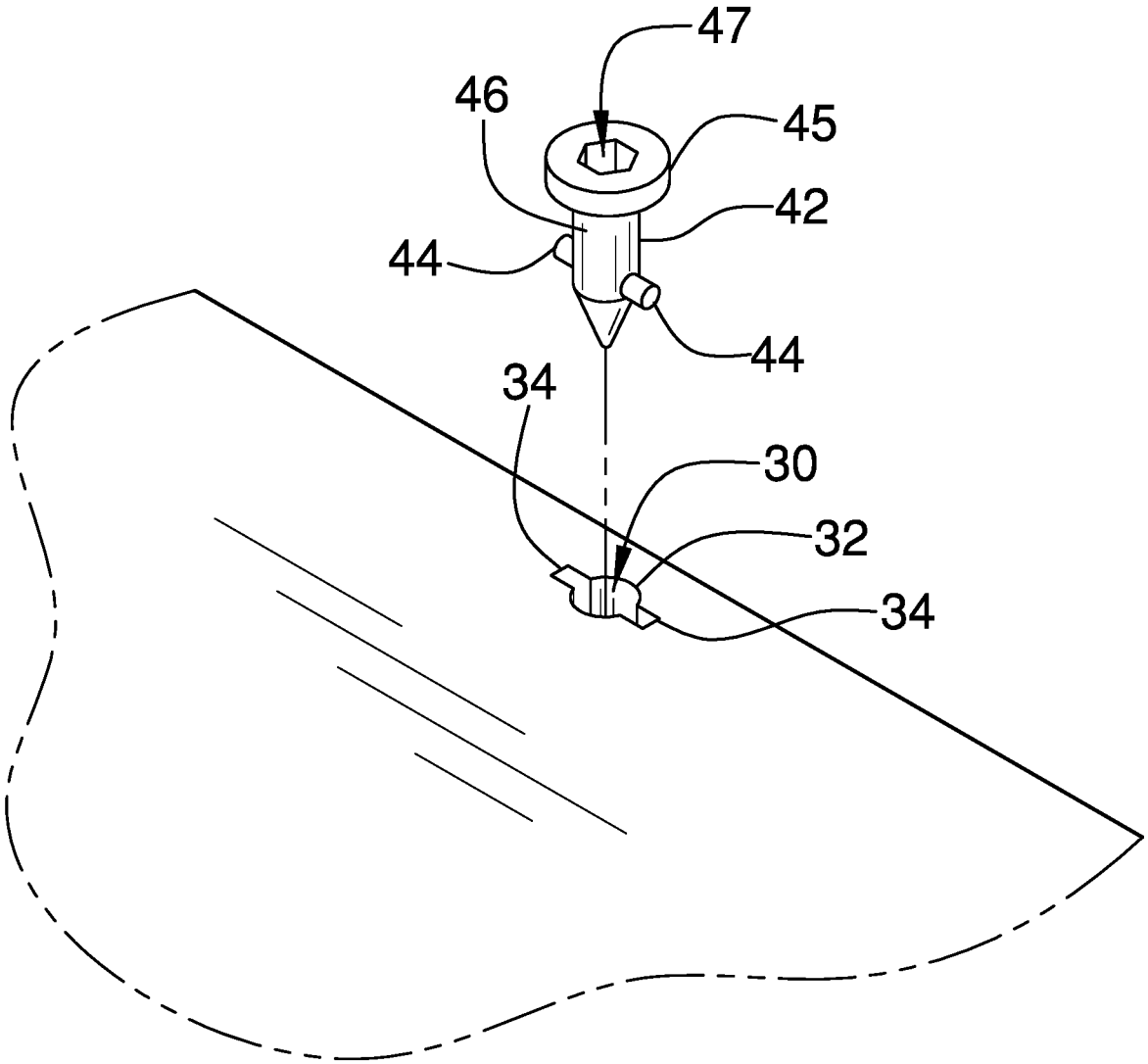
FIG. 7 is a perspective view of an embodiment of the disclosure showing a pin being inserted into an aperture.
Figure 8:
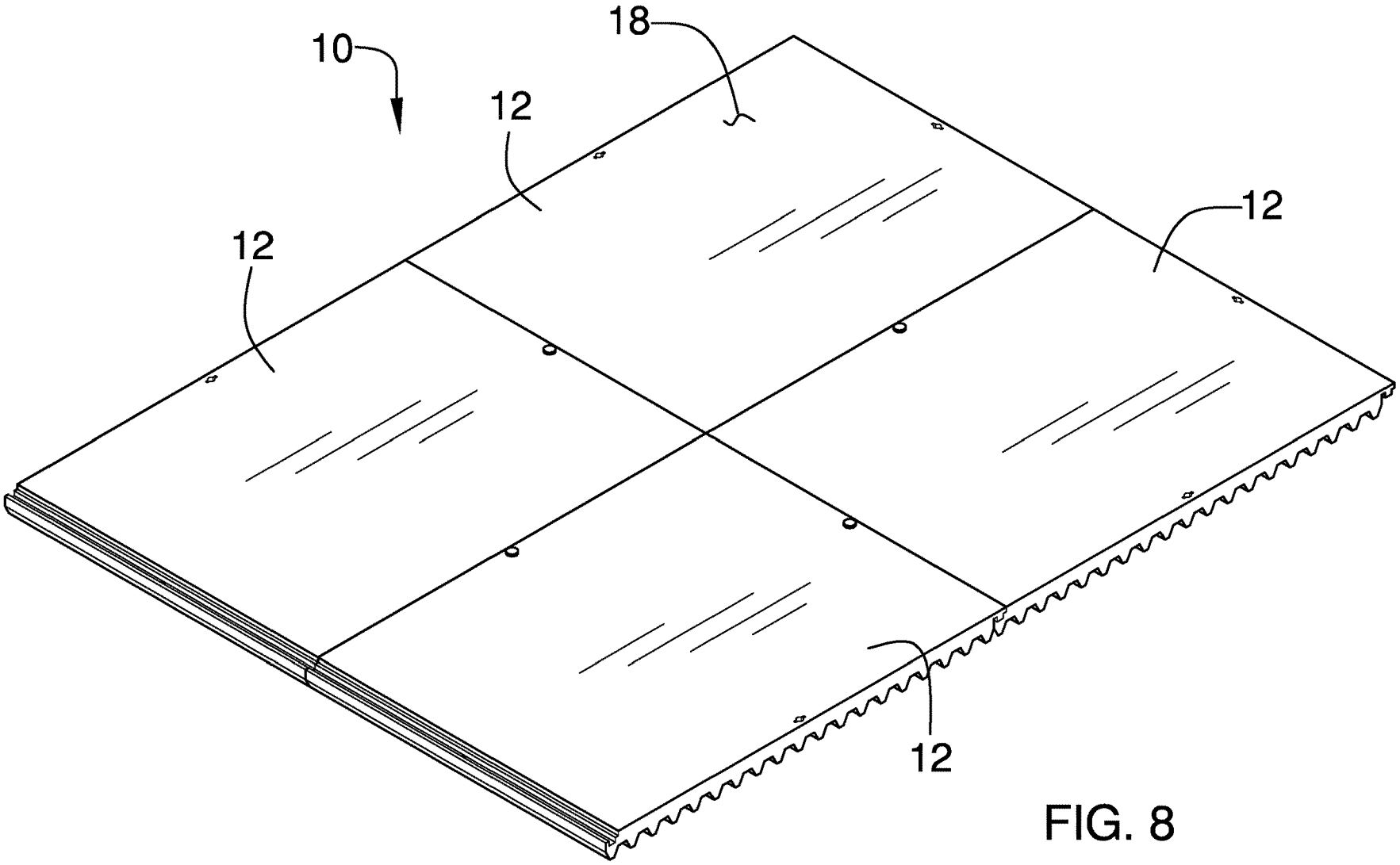
FIG. 8 is a perspective in-use view of an embodiment of the disclosure.

With reference now to the drawings, and in particular to FIGS. 1 through 11 thereof, a new decking device embodying the principles and concepts of an embodiment of the disclosure and generally designated by the reference numeral 10 will be described.

As best illustrated in FIGS. 1 through 11, the modular decking assembly 10 generally comprises a plurality of panels 12, and each of the panels 12 has a tongue 14 and a groove 16. The tongue 14 on each of the panels 12 releasably engages the groove 16 on an adjacent one of the panels 12. In this way the panels 12 can be coupled together to define a support surface 18 for standing or sitting. Each of the panels 12 is positionable on the ground and each of the panels 12 is comprised of a fluid impermeable material. In this way the panels 12 inhibit people's feet from getting wet during standing.

Each of the panels 12 has a top surface 20, a bottom surface 22 and a perimeter edge 24 extending therebetween, and the perimeter edge 24 of each of the panels 12 has a first lateral side 26 and a second lateral side 28. The groove 16 in each of the panels 12 extends downwardly into the top surface 20, and the groove 16 is spaced from and is coextensive with the first lateral side 26. The tongue 14 on each of the panels 12 extends downwardly from the bottom surface 22, and the tongue 14 is spaced from and is coextensive with the second lateral side 28.

Each of the panels 12 has an aperture 30 extending through the top surface 20 and the bottom surface 22. The aperture 30 has a tubular portion 32 and a pair of keyed portions 34 each extending away from the tubular portion 32. Moreover, the aperture 30 extends through the tongue 14. Each of the panels 12 has a well 36 extending downwardly into the top surface 20 and the well 36 is positioned in the groove 16. The aperture 30 is aligned with the well 36 in an adjacent panel 12 when tongue 14 of one panel is positioned in the groove 16 on the adjacent panel 12.

The bottom surface 22 has a plurality of depressions 38 therein and each of the depressions 38 extends across a full width of the panel 12. The depressions 38 are spaced apart from each other and are distributed between the first lateral side 26 and the second lateral side 28 of the perimeter edge 24 of the panel 12. Thus, a plurality of ridges 40 is defined on the bottom surface 22. The depressions 38 accommodate water, mud or other viscous material when the panel 12 is placed on the ground thereby inhibiting the panel 12 from floating.

A plurality of pins 42 is provided and each of the pins 42 is extendable through a respective panel 12 and engages an adjacent panel 12. In this way the panels 12 are removably coupled together. Each of the pins 42 has a pair of keys 44 each extending away from a shaft 46. The shaft 46 extends through the tubular portion 32 of the aperture 30 having each of the keys 44 extending through a respective one of the keyed portions 34 of the aperture 30. The shaft 46 extends into the well 36 in the adjacent panel 12. Moreover, the pin 42 is rotatable into a locking position having each of keys 44 being offset from the respective keyed portions 34 of the aperture 30. In this way the pin 42 is inhibited from being removed from the aperture 30. Each of the pins 42 may have a head 45 which has a recess 47 for an allen wrench or the like.

Figure 10:
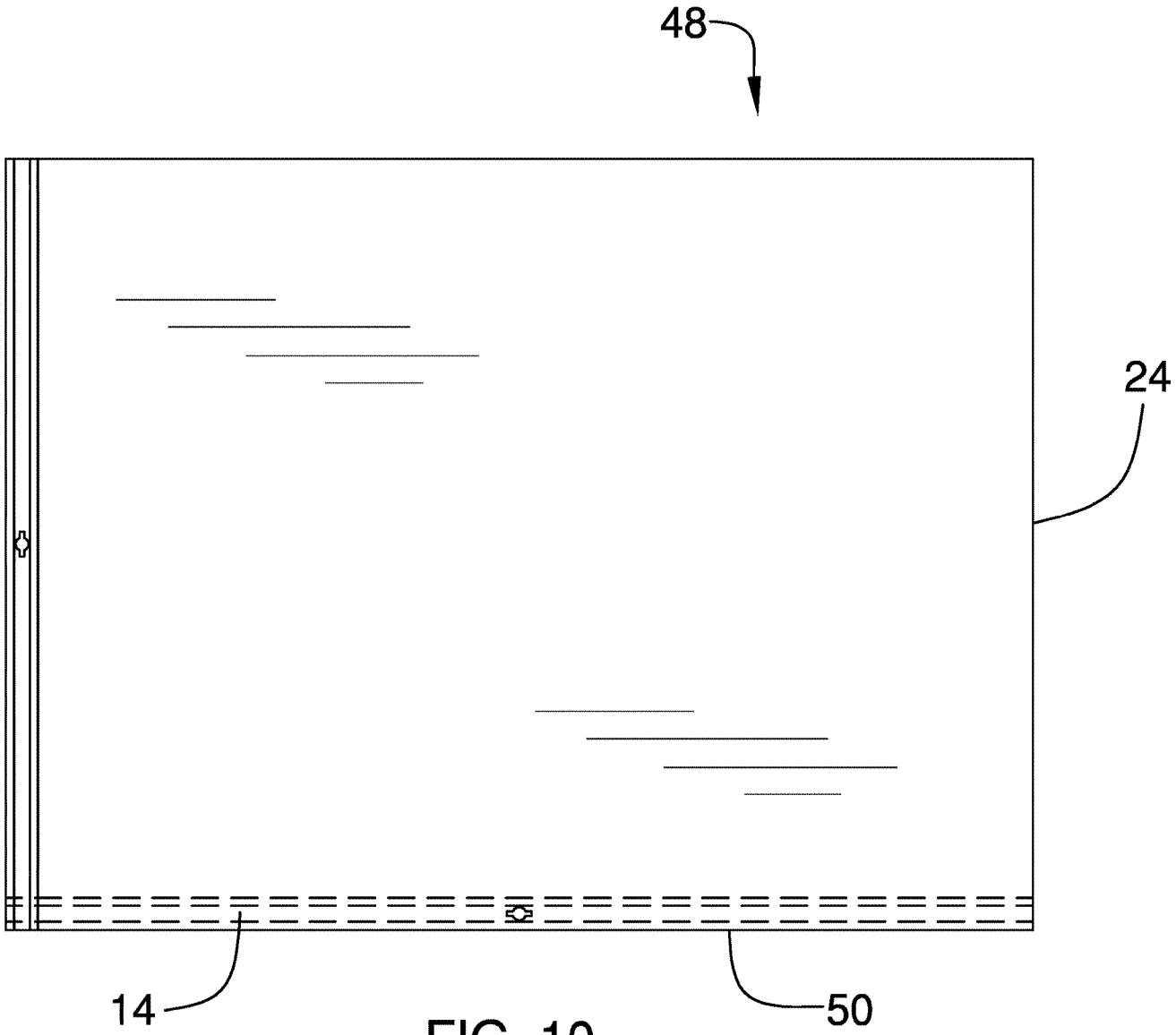
FIG. 10 is a top phantom view of at least one corner panel of an embodiment of the disclosure.
Figure 11:
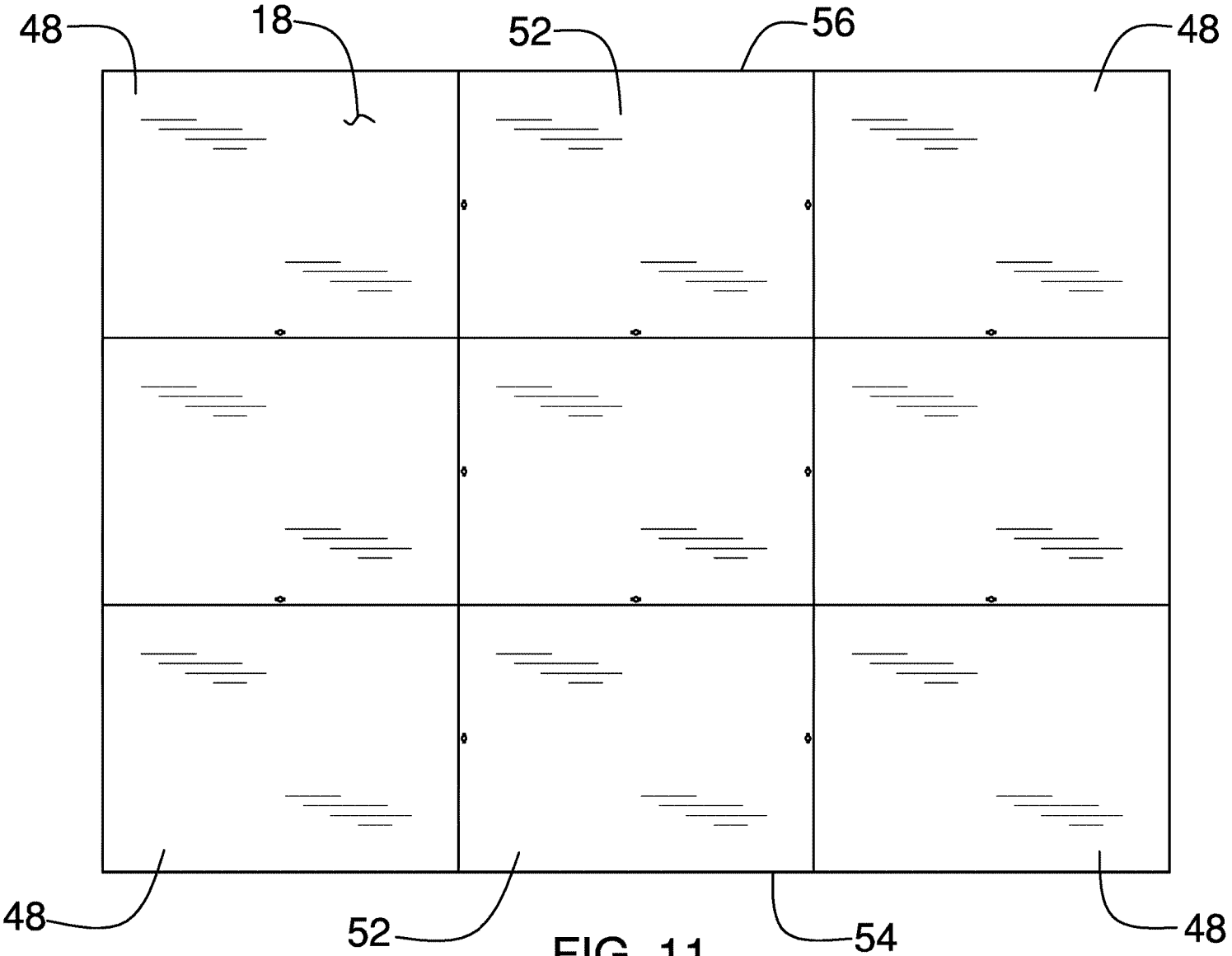
FIG. 11 is a top in-use view of an embodiment of the disclosure.

As is most clearly shown in FIG. 10, the plurality of panels 12 includes at least one corner panel 48. The tongue 14 on the at least one corner panel 48 is aligned with and is coextensive with a front side 50 of the perimeter edge 24 of the at least one corner panel 48. In this way the at least one corner panel 48 can define one of four corners of the support surface 18 defined by the panels 12 when the panels 12 are attached together.

Figure 9:
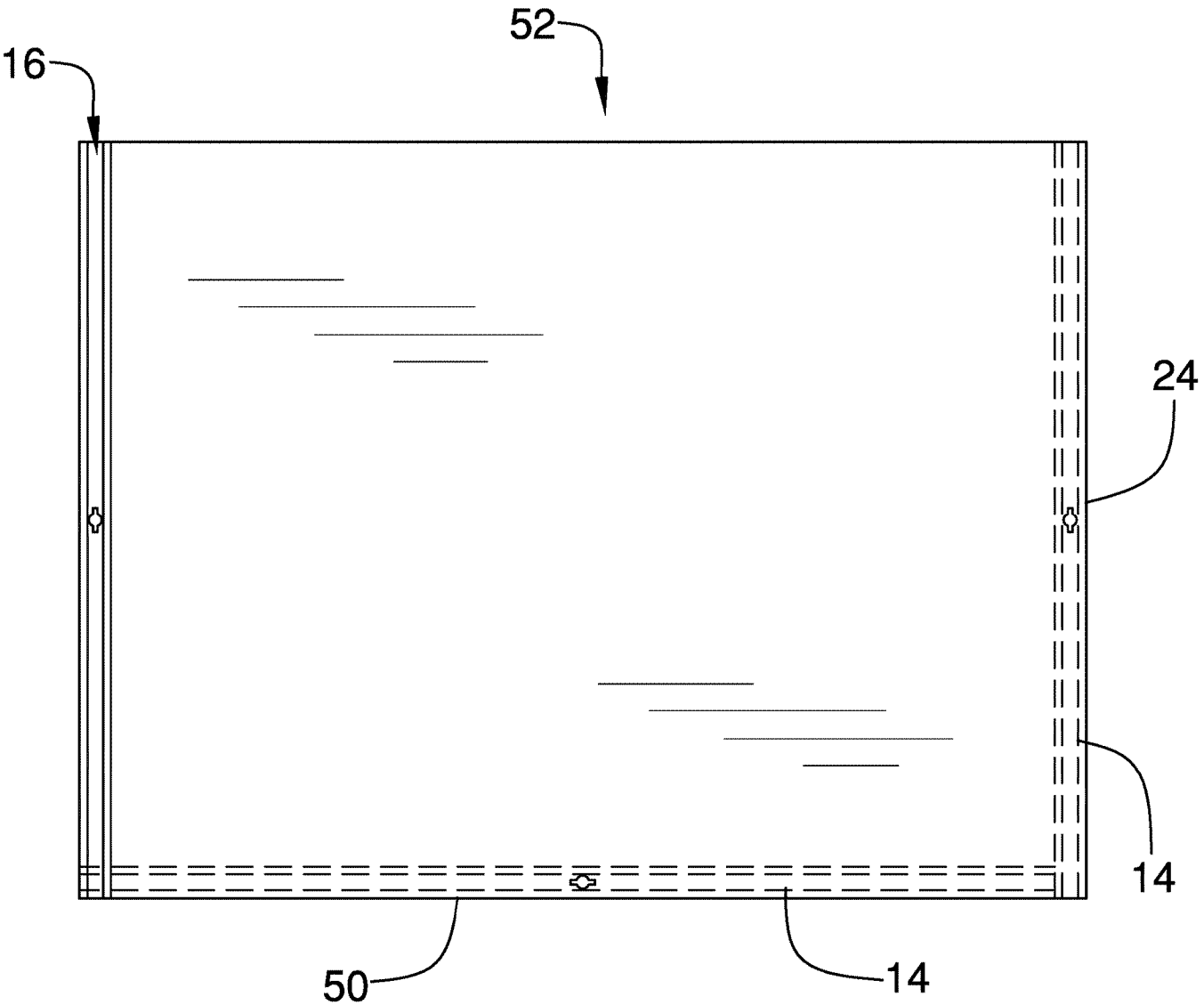
FIG. 9 is a top phantom view of at least one middle panel of an embodiment of the disclosure.

As is most clearly shown in FIG. 9, the plurality of panels 12 includes at least one middle panel 52. The at least one middle panel 52 has a tongue 14 that is aligned with and is coextensive with the front side 50 of the perimeter edge 24 of the at least one middle panel 52. In this way the at least one middle panel 52 can define a middle of a front edge 54 or a middle of a back edge 56 of the support surface 18 defined by the panels 12 when the panels 12 are attached together.

In use, the plurality of panels 12 are laid on the ground prior to a dance, party or other outdoor event involving many people standing or sitting on the support surface 18. The tongue 14 on each panel is positioned in the groove 16 of an adjacent panel 12 to define the support surface 18 for the people to stand upon and to sit upon. Additionally, each of the pins 42 is extended through the panels 12 to inhibit the panels 12 from being separated from each other. In this way the panels 12 facilitate a dry surface on which the people can stand or sit. The panels 12 are uncoupled from each other and are packet away when the outdoor event is finished.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A modular decking assembly being configured to be placed on ground thereby facilitating people to stand on a dry surface, said assembly comprising:

a plurality of panels, each of said panels having a tongue and a groove, said tongue on each of said panels releasably engaging said groove on an adjacent one of said panels thereby facilitating said panels to be coupled together to define a support surface for standing or sitting, each of said panels being positionable on the ground, each of said panels being comprised of a fluid impermeable material wherein said panels are configured to inhibit people's feet from getting wet during standing, each of said panels having a top surface, a bottom surface and a perimeter edge extending therebetween, said perimeter edge of each of said panels having a first lateral side and a second lateral side, said groove in each of said panels extends downwardly into said top surface, said groove being spaced from and being coextensive with said first lateral side, said tongue on each of said panels extending downwardly from said bottom surface, said tongue being spaced from and being coextensive with said second lateral side, each of said panels having an aperture extending through said top surface and said bottom surface, said apertures having a tubular portion and a pair of keyed portions each extending away form said tubular portion, said aperture extending through said tongue, each of said panels having a well extending downwardly into said top surface, said well being positioned in said groove, said aperture in one of said panels being aligned with said well in an adjacent panel when said tongue of said one panel is positioned in said groove on said adjacent panel; and a plurality of pins, each of said pins being extendable through a respective panel and engaging an adjacent panel for removably coupling said panels together, each of said pins having a pair of keys, each of said keys being cylindrical extending perpendicularly away from a shaft such that uppermost edges of said keys are coplanar across said shaft, said shaft extending through said tubular portion of said aperture having each of said keys extending through a respective one of said keyed portions of said aperture, said shaft extending into said well in said adjacent panel, said pin being rotatable into a locking position having each of keys being offset from said respective keyed portions of said aperture thereby inhibiting said pin from being removed from said aperture.

2. The assembly according to claim 1, wherein said bottom surface has a plurality of depressions therein, each of said depressions extending across a full width of said panel.

3. A modular decking assembly being configured to be placed on ground thereby facilitating people to stand on a dry surface, said assembly comprising:

a plurality of panels, each of said panels having a tongue and a groove, said tongue on each of said panels releasably engaging said groove on an adjacent one of said panels thereby facilitating said panels to be coupled together to define a support surface for standing or sitting, each of said panels being positionable on the ground, each of said panels being comprised of a fluid impermeable material wherein said panels are configured to inhibit people's feet from getting wet during standing, each of said panels having a top surface, a bottom surface and a perimeter edge extending therebetween, said perimeter edge of each of said panels having a first lateral side and a second lateral side, said groove in each of said panels extending downwardly into said top surface, said groove being spaced from and being coextensive with said first lateral side, said tongue on each of said panels extending downwardly from said bottom surface, said tongue being spaced from and being coextensive with said second lateral side, each of said panels having an aperture extending through said top surface and said bottom surface, said apertures having a tubular portion and a pair of keyed portions each extending away form said tubular portion, said aperture extending through said tongue, each of said panels having a well extending downwardly into said top surface, said well being positioned in said groove, said aperture being aligned with said well in an adjacent panel when tongue of one panel is positioned in said groove on said adjacent panel, said bottom surface having a plurality of depressions therein, each of said depressions extending across a full width of said panel, said depressions being spaced apart from each other and being distributed between said first lateral side and said second lateral side of said perimeter edge of said panel to define a plurality of ridges on said bottom surface wherein each of said depressions is configured to accommodate water, mud or other viscous material when said panel is placed on the ground thereby inhibiting said panel from floating; and a plurality of pins, each of said pins being extendable through a respective panel and engaging an adjacent panel for removably coupling said panels together, each of said pins having a pair of keys, each of said keys being cylindrical extending perpendicularly away from a shaft such that uppermost edges of said keys are coplanar across said shaft, said shaft extending through said tubular portion of said aperture having each of said keys extending through a respective one of said keyed portions of said aperture, said shaft extending into said well in said adjacent panel, said pin being rotatable into a locking position having each of keys being offset from said respective keyed portions of said aperture thereby inhibiting said pin from being removed from said aperture.

4. The assembly according to claim 3, wherein said plurality of panels includes at least one corner panel, said tongue on said at least one corner panel being aligned with and being coextensive with a front side of said perimeter edge of said at least one corner panel thereby facilitating said at least one corner panel to define one of four corners of said support surface defined by said panels.

5. A modular decking assembly being configured to be placed on ground thereby facilitating people to stand on a dry surface, said assembly comprising:

a plurality of panels, each of said panels having a tongue and a groove, said tongue on each of said panels releasably engaging said groove on an adjacent one of said panels thereby facilitating said panels to be coupled together to define a support surface for standing or sitting, each of said panels being positionable on the ground, each of said panels being comprised of a fluid impermeable material wherein said panels are configured to inhibit people's feet from getting wet during standing, each of said panels having a top surface, a bottom surface and a perimeter edge extending therebetween, said perimeter edge of each of said panels having a first lateral side and a second lateral side, said groove in each of said panels extending downwardly into said top surface, said groove being spaced from and being coextensive with said first lateral side, said tongue on each of said panels extending downwardly from said bottom surface, said tongue being spaced from and being coextensive with said second lateral side, each of said panels having an aperture extending through said top surface and said bottom surface, said apertures having a tubular portion and a pair of keyed portions each extending away form said tubular portion, said aperture extending through said tongue, each of said panels having a well extending downwardly into said top surface, said well being positioned in said groove, said aperture being aligned with said well in an adjacent panel when tongue of one panel is positioned in said groove on said adjacent panel, said bottom surface having a plurality of depressions therein, each of said depressions extending across a full width of said panel, said depressions being spaced apart from each other and being distributed between said first lateral side and said second lateral side of said perimeter edge of said panel to define a plurality of ridges on said bottom surface wherein each of said depressions is configured to accommodate water, mud or other viscous material when said panel is placed on the ground thereby inhibiting said panel from floating;

a plurality of pins, each of said pins being extendable through a respective panel and engaging an adjacent panel for removably coupling said panels together, each of said pins having a pair of keys each extending away from a shaft, said shaft extending through said tubular portion of said aperture having each of said keys extending through a respective one of said keyed portions of said aperture, said shaft extending into said well in said adjacent panel, said pin being rotatable into a locking position having each of keys being offset from said respective keyed portions of said aperture thereby inhibiting said pin from being removed from said aperture; and said plurality of panels includes at least one middle panel, said at least one middle panel has a tongue being aligned with and being coextensive with a front side of said perimeter edge of said panel thereby facilitating said at least one middle panel to define a middle of a front edge or a middle of a back edge of said support surface defined by said panels.

* * * * *